US009493006B2

(12) United States Patent
Kanbe

(10) Patent No.: US 9,493,006 B2
(45) Date of Patent: Nov. 15, 2016

(54) PRINTING APPARATUS AND CARTRIDGE

(71) Applicant: Tomohiro Kanbe, Nagoya (JP)

(72) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/222,051

(22) Filed: Mar. 21, 2014

(65) Prior Publication Data

US 2014/0292960 A1 Oct. 2, 2014

(30) Foreign Application Priority Data

Mar. 27, 2013 (JP) ..... 2013-065425

(51) Int. Cl.
*B41J 2/175* (2006.01)

(52) U.S. Cl.
CPC ..... *B41J 2/1752* (2013.01)

(58) Field of Classification Search
None
See application file for complete search history.

(56) References Cited

U.S. PATENT DOCUMENTS

| | | | | |
|---|---|---|---|---|
| 7,971,977 | B2 | 7/2011 | Nakata et al. | |
| 8,192,001 | B2 | 6/2012 | Umeda | |
| 2007/0273734 | A1 | 11/2007 | Nakata et al. | |
| 2008/0239034 | A1 | 10/2008 | Umeda | |
| 2009/0039002 | A1* | 2/2009 | Umeda | B41J 2/17509 210/100 |
| 2009/0278902 | A1 | 11/2009 | Iwata et al. | |
| 2010/0141718 | A1 | 6/2010 | Petranek et al. | |
| 2011/0310197 | A1* | 12/2011 | Yazawa | 347/86 |
| 2012/0056955 | A1 | 3/2012 | Kodama et al. | |
| 2012/0249691 | A1* | 10/2012 | Takagi et al. | 347/86 |

FOREIGN PATENT DOCUMENTS

| | | | |
|---|---|---|---|
| JP | 2007223130 | A | 9/2007 |
| JP | 2009039870 | A | 2/2009 |
| JP | 2010228377 | A | 10/2010 |
| JP | 2010228380 | A | 10/2010 |

OTHER PUBLICATIONS

Jun. 30, 2016 —(EP) Extended European Search Report—App 14161570.8.
Aug. 30, 2016—(CN) Notification of First Office Action—App 20140119715.9.

* cited by examiner

*Primary Examiner* — An Do
*Assistant Examiner* — Renee I Wilson
(74) *Attorney, Agent, or Firm* — Banner & Witcoff, Ltd.

(57) ABSTRACT

The printing fluid supply apparatus comprises the printing fluid cartridge and a cartridge accommodating portion. The cartridge accommodating portion comprises a casing, and an engage member. The printing fluid cartridge comprises a main body including a chamber, an ink outlet portion, an engage portion, a contact portion, and a biasing member. The contact portion allows the engage member to rotate toward the first position by contacting with the engage member and allows the biasing member to make elastic deformation while the printing fluid cartridge installing to the casing. The engage member in the first position engages the engage portion, and the printing fluid cartridge is held in an accommodated position against the biasing portion when the printing fluid cartridge is achieved to the accommodated position in the casing. The biasing portion allows the printing fluid cartridge being held in the casing to move opposite to the insertion direction when the engage member rotates to the second position.

19 Claims, 8 Drawing Sheets

PRINTING APPARATUS AND CARTRIDGE

CROSS REFERENCE TO RELATED APPLICATIONS

The present application claims priority to Japanese Application JP2013-065425, filed Mar. 27, 2013, the contents of which are hereby incorporated by reference as an example embodiment.

BACKGROUND OF THE DISCLOSURE

1. Field of the Disclosure

The present disclosure relates to a printing fluid supply apparatus including a cartridge attaching unit and a printing fluid cartridge attached to the cartridge attaching unit and relates to a printing fluid cartridge.

2. Description of the Related Art

There are image recording apparatuses for recording images on recording sheets using ink. One example of such image recording apparatuses includes an inkjet recording head and selectively discharges ink droplets through nozzles of the recording head toward a recording sheet. The ink droplets reach the recording sheet, thereby recording a desired image on the recording sheet. The image recording apparatus includes an ink cartridge that stores ink to be supplied to the recording head. The ink cartridge is attachable to and detachable from an attaching unit in the image recording apparatus.

When the ink in the ink cartridge has run out, the ink cartridge is detached from the attaching unit in the image recording apparatus and a new ink cartridge that stores ink is attached to the attaching unit. See, for example, Japanese Unexamined Patent Application Publication Nos. 2009-39870 and 2010-228377. As described therein, the attaching unit may include a locking structure for positioning the ink cartridge and holding the ink cartridge at an attached state. There is a biasing member for biasing the ink cartridge in a direction in which the ink cartridge is detached from the attaching unit in a state where the ink cartridge is locked by the locking structure. In detaching the ink cartridge from the attaching unit, the locking by the locking structure is released, and the ink cartridge is moved toward an opening by a force received by the biasing member. This enables a user to easily remove the ink cartridge from the attaching unit.

To respond to desires to reduce the size and cost of the image recording apparatus, it is desired that the number of parts in the ink cartridge and its peripheral members be reduced. For example, an existing locking structure for an ink cartridge needs separate springs, one for biasing the ink cartridge in a detaching direction and one for urging a locking lever.

SUMMARY OF THE DISCLOSURE

In some embodiments described herein, a printing apparatus may include an engage member configured to rotate between a first position and a second position; and a biasing member configured to provide a biasing force to hold the engage member in the first position to lock a cartridge in a casing, and to provide a biasing force to eject the cartridge from the casing when the engage member is in the second position, wherein the biasing member is attached to the cartridge. In some embodiments, the engage member includes an axis of rotation, and wherein the biasing member abuts the engage member at a first location on the engage member, and wherein a smallest distance between the axis of rotation and a support surface of the cartridge is smaller than a smallest distance between the first location and the support surface of the cartridge. The biasing member may be a spring, and may include a contact portion that abuts the engage member at the first location on the engage member. In some embodiments, the engage member has a first end, and is configured such that the first end abuts an engage portion of the cartridge when the engage member is in the first position, and the engage portion may be a vertical step from the support surface. In some embodiments, a cartridge may include a main body configured to be inserted into a device in a first direction; a biasing portion configured to provide a biasing force in the first direction; and an engage portion, wherein the cartridge is configured to accept an engage member of the device between the biasing member and the engage portion, and to convey the biasing force to the engage portion via the engage member, In some embodiments, the biasing portion is located above a support surface of the cartridge, wherein the biasing portion is configured to abut the engage member at a first location on the engage member, and wherein a smallest distance between an axis of rotation and the support surface of the cartridge is smaller than a smallest distance between the first location and the support surface of the cartridge. The biasing portion may be coupled to a protrusion extending frontwards from the rear of the main body, and may include a contact portion configured to abut the engage portion at a first location on the engage portion. In some embodiments, a cartridge may include a main body having a front and a rear; a biasing portion located above a first surface of the main body, configured to provide a biasing force towards the front of the main body; and an engage portion on the first surface of the main body, wherein the engage portion is a rise facing the rear of the main body, and wherein the biasing portion is located rearward of the engage portion. In some embodiments, the first surface is a top surface having a flat support surface and a flat upper wall, and wherein the engage portion is a vertical step from the support surface to the upper wall, and the biasing portion may be coupled to a protrusion extending frontwards from the rear of the main body. In some embodiments, the cartridge is configured to accept an engage portion of a device between the biasing portion and the engage portion, and to convey the biasing force to the engage portion via the engage portion.

DESCRIPTION OF THE EXAMPLE EMBODIMENTS

An embodiment will be described below with reference to the drawings. The embodiment described below is merely a specific example, and modifications may be made to the embodiment without departing from the scope or spirit of the present application.

Overview of Printer 10

Figure 1:
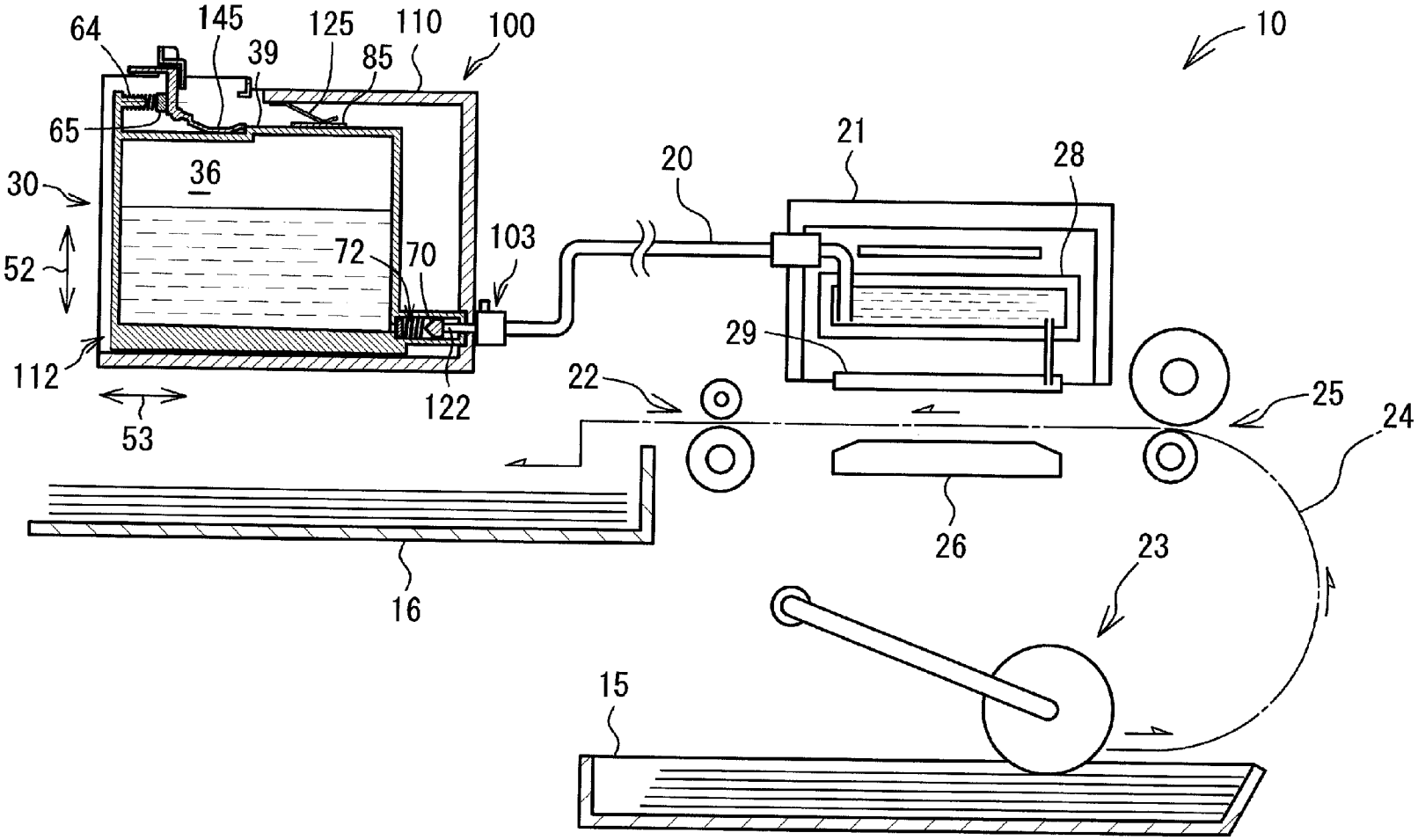
FIG. 1 is a schematic cross-sectional view that schematically illustrates an internal structure of a printer including an ink supply apparatus according to an embodiment of the present disclosure.

As illustrated in FIG. 1, a printer 10 may be configured to record an image on a recording sheet by selectively discharging ink droplets thereto using an inkjet recording method. The printer 10 may include a printing fluid supply apparatus 100. The printing fluid supply apparatus 100 may include a cartridge attaching unit 110 corresponding that may serve as a cartridge accommodating portion. An ink cartridge 30 may be attachable to the cartridge attaching unit 110. The ink cartridge 30 may serve as a printing fluid cartridge. The cartridge attaching unit 110 may include an opening 112 through which one surface of the cartridge attaching unit 110 is opened to the outside. The ink cartridge 30 may be insertable into or removable from the cartridge attaching unit 110 through the opening 112.

The ink cartridge 30 may store ink usable in the printer 10. The ink may be a printing fluid. In a state where the ink cartridge 30 is attached to the cartridge attaching unit 110, the ink cartridge 30 and a recording head 21 may be connected to each other with an ink tube 20. The recording head 21 may include a sub-tank 28. The sub-tank 28 may temporarily store ink supplied through the ink tube 20. The recording head 21 may selectively discharge ink supplied from the sub-tank 28 through nozzles 29 using the inkjet recording method.

A recording sheet sent from a paper feed tray 15 to a conveyance path 24 by a paper feed roller 23 may be conveyed above a platen 26 by a pair of conveyance rollers 25. The recording head 21 selectively may discharge ink to the recording sheet passing over the platen 26. In this way, an image may be recorded on the recording sheet. The recording sheet having passed over the platen 26 may be ejected to a paper output tray 16 disposed on the most downstream side of the conveyance path 24 by a pair of eject rollers 22.

Ink Cartridge 30

Figure 2:
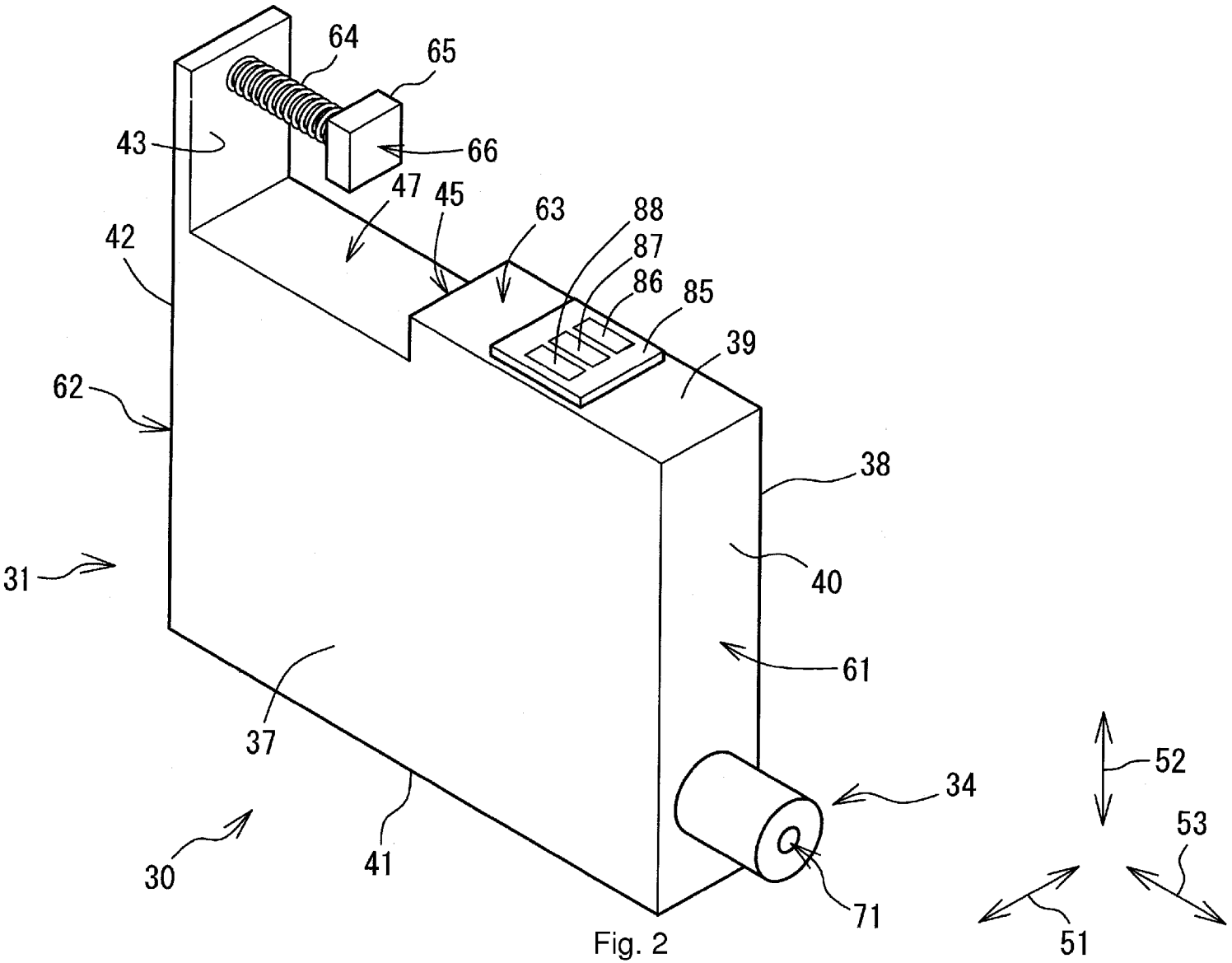
FIG. 2 is a perspective view that illustrates an outer appearance configuration of an ink cartridge.
Figure 3:
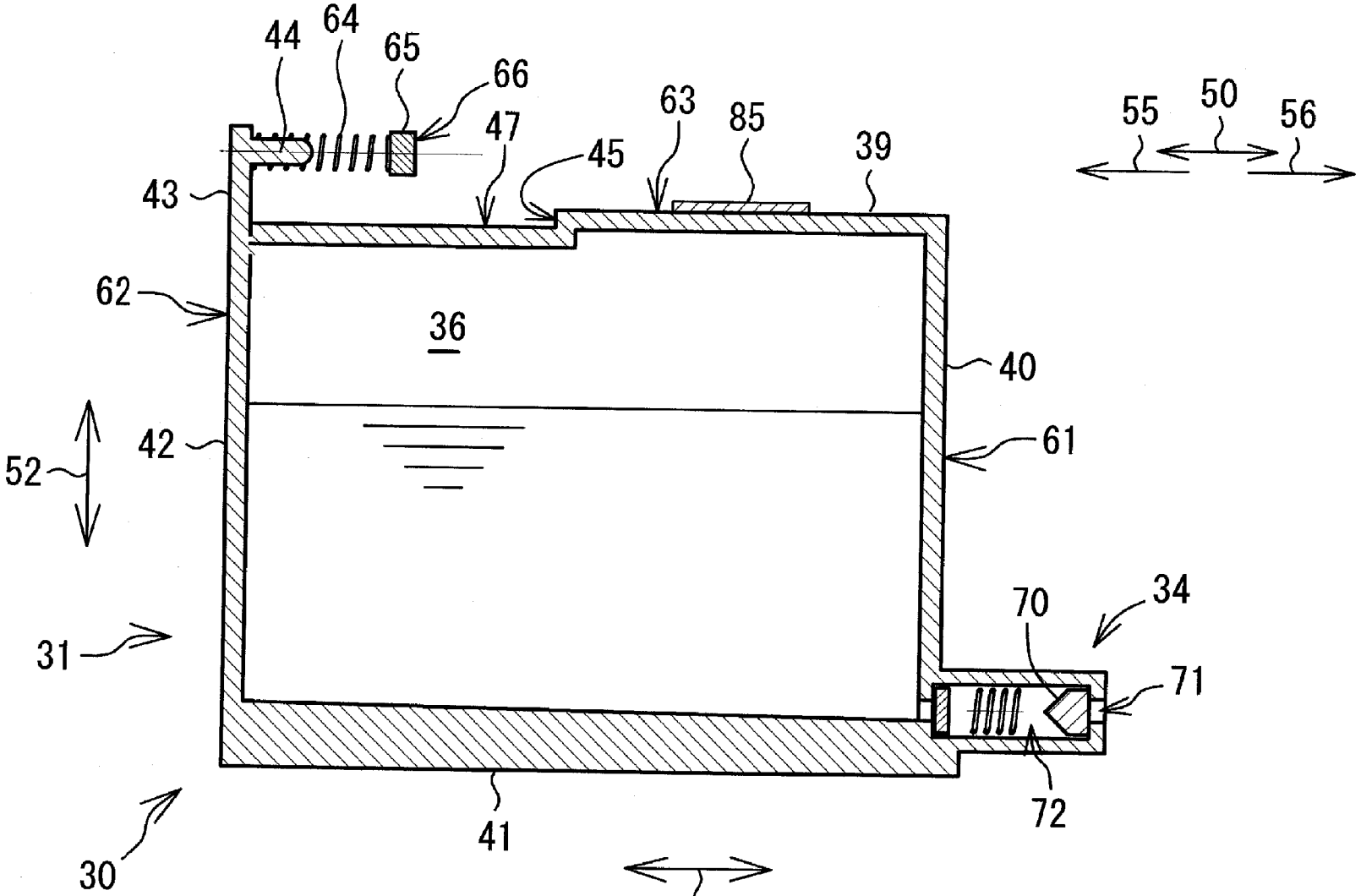
FIG. 3 is a cross-sectional view that illustrates an internal configuration of the ink cartridge.

The ink cartridge 30 illustrated in FIGS. 2 and 3 may be a container that stores ink. As illustrated in FIGS. 1 and 3, a space inside a main body 31 forming the outer appearance of the ink cartridge 30 may be an ink chamber 36 storing ink. The ink chamber 36 may be formed from an internal frame that is a member different from the housing of the main body 31 or may also be formed from the housing of the main body 31.

The ink cartridge 30 in a standing state illustrated in FIGS. 2 and 3, that is, in a state where the lower surface in these drawings is a bottom surface and the upper surface in these drawings is an upper surface, is insertable into and removable from the cartridge attaching unit 110 along a direction indicated by arrows 50 (see FIG. 4A; hereinafter referred to as "insertion and removal direction 50"). The insertion and removal direction 50 may extend along a horizontal direction. The ink cartridge 30 may be insertable into and removable from the cartridge attaching unit 110 while remaining in the standing state. A direction in which the ink cartridge 30 may be attached to the cartridge attaching unit 110 may be an insertion direction 56 extending along the horizontal direction, and a direction in which the ink cartridge 30 may be detached therefrom may be a removal direction 55. The insertion direction 56 may be a first direction, and the removal direction 55 may be a second direction. A vertical direction 52 in the standing state corresponds to a gravitational direction (perpendicular direction). That is, the ink cartridge 30 may be insertable into the cartridge attaching unit 110 along the insertion and removal direction 50 and removable from the cartridge attaching unit 110 along the insertion and removal direction 50. The insertion and removal direction 50, which extends along the horizontal direction in the present embodiment, may be the gravitational direction or a direction orthogonal to the horizontal direction and the gravitational direction.

Main Body 31

As illustrated in FIGS. 2 and 3, the ink cartridge 30 may include the main body 31 having a substantially rectangular parallelepiped shape. The ink cartridge 30 may have a flat shape, as the whole, that is narrow in a lateral direction 51 and that has lengths in the vertical direction 52 and longitudinal direction 53 larger than the length in the lateral direction 51. The wall that is the front in the insertion direction 56 at the time of attaching the ink cartridge 30 to the cartridge attaching unit 110 may be a front wall 40, and the wall that is the rear in the insertion direction 56 at that time is a rear wall 42. The front wall 40 may include a front surface 61 on the front side in the insertion direction 56, and the front surface 61 may serve as a first surface. The rear wall 42 may have a rear surface 62 on the rear side in the insertion direction 56, and the rear surface 62 may serve as a second surface. The front wall 40 and the rear wall 42 may be opposed to each other in the insertion and removal direction 50. The front wall 40 and the rear wall 42 may be defined by the four walls consisting of a pair of left and right side walls 37 and 38 extending in the insertion and removal direction 50, an upper wall 39 connecting the side walls 37 and 38 and the front and rear walls 40 and 42 and extending from the upper end of the front wall 40 to the upper end of the rear wall 42, and a lower wall 41 extending from the lower end of the front wall 40 to the lower end of the rear wall 42. The insertion and removal direction 50 may be parallel to the longitudinal direction 53.

Ink Outlet Portion 34

As illustrated in FIGS. 2 and 3, an ink outlet portion 34 may be disposed on the lower portion of the front wall 40 in the main body 31. The ink outlet portion 34 may have a substantially cylindrical external shape and may project outward from the front wall 40 (specifically, the front surface 61 of the front wall 40) along the insertion and removal direction 50. The ink outlet portion 34 may include an ink supply port 71 at its projection end.

The ink outlet portion 34 may include an ink channel 72 extending from the ink supply port 71 through its internal space along the insertion and removal direction 50 and communicating with the ink chamber 36. The ink supply port 71 may be openable and closable by an ink supply valve 70. When the ink cartridge 30 is attached to the cartridge attaching unit 110, an ink needle 122 (see FIG. 4A) in the cartridge attaching unit 110 may be inserted into the ink supply port 71 and may open the ink supply valve 70. That is, the ink outlet portion 34 may be coupled to the ink needle 122. This may cause the ink to flow from the ink chamber 36 to the ink needle 122 in the cartridge attaching unit 110 through the ink channel 72.

The ink supply port 71 is not limited to the configuration openable and closable by the ink supply valve 70. For example, the ink supply port 71 may be a configuration in which it is blocked by a film or the like and opened by the ink needle 122 piercing the film when the ink cartridge 30 is attached to the cartridge attaching unit 110.

Engage Portion 45

As illustrated in FIGS. 2 and 3, an engage portion 45 may be disposed in the vicinity of the center of the upper wall 39 in the main body 31 in the longitudinal direction 53. The engage portion 45 may be a rise intersecting with a support surface 47 recessed downward from the upper wall 39, extending along the lateral direction 51 and the vertical direction 52 of the main body 31 in the ink cartridge 30, and extending in a direction away from the main body 31. In the present embodiment, the engage portion 45 and the support surface 47 may be perpendicular to each other. The support surface 47 may be situated between the front surface 61 and the rear surface 62. The engage portion 45 may extend upward from the front end of the support surface 47 and be connected to the upper wall 39. The engage portion 45 may face the removal direction 55. The upward direction may be a third direction. The engage portion 45 may be a fourth surface. The engage portion 45 may be a surface that can receive an external force from the outside toward the front direction.

The engage portion 45 may be engaged with an engage member 145, which is described below, in the state where the ink cartridge 30 is attached to the cartridge attaching unit 110 (the state illustrated in FIG. 6B), that is, in the state where the ink cartridge 30 is in an attached position. The engage portion 45 may receive a biasing force that presses the ink cartridge 30 in the removal direction 55. In the present embodiment, the engage portion 45 may be arranged so as to intersect with the removal direction 55, thereby receiving the biasing force. In the present embodiment, the engage portion 45 may be a rise. However, the engage portion 45 is not limited to the rise, and it may be any portion that can engage with the engage member 145 when the ink cartridge 30 is in the attached position. For example, the engage portion 45 may be a protruding portion that protrudes upward from the support surface 47.

Coil Spring 64 and Abutment 65

As illustrated in FIGS. 2 and 3, the main body 31 may include a support wall 43 protruding upward from the upper end of the rear wall 42. The support wall 43 in the present embodiment may have a board shape that extends along the lateral direction 51 and the vertical direction 52 of the ink cartridge 30. A protrusion 44 protruding in the insertion direction 56 may be disposed on the surface of the support wall 43 facing the insertion direction 56.

A coil spring 64 may be arranged in a state where the protrusion 44 is inserted therein. Thus the coil spring 64 may be supported by the protrusion 44. The end of the coil spring 64 adjacent to the protrusion 44 may be in contact with the support wall 43. The coil spring 64 may be elastically deformable along the insertion and removal direction 50. The coil spring 64 may be arranged above the ink outlet portion 34 in the state where the ink cartridge 30 is attached to the cartridge attaching unit 110, that is, in the state where the ink cartridge 30 is in the attached position. The coil spring 64 corresponds to a biasing member.

An abutment 65 may be mounted on the end of the coil spring 64 opposite to the protrusion 44. The abutment 65 may be arranged rearward of the engage portion 45 in the insertion direction 56. The position of the abutment 65 in the vertical direction 52 may be above the engage portion 45. In other words, the abutment 65 may be arranged in a position farther from the support surface 47, which is the outer surface of the main body 31, than the engage portion 45.

Because the abutment 65 may be mounted on the end of the coil spring 64 opposite to the protrusion 44, if the coil spring 64 is elastically deformed in a direction extending along the insertion direction 56, that is, in the insertion and removal direction 50, the abutment 65 works with the elastic deformation and moves in the insertion and removal direction 50. The abutment 65 may be a contact portion.

The abutment 65 may include an abutting surface 66 extending in the lateral direction 51 and the vertical direction 52 on the side opposite the coil spring 64, that is, the side facing the insertion direction 56. The abutting surface 66 may be a fifth surface. The abutment 65 may be arranged such that the abutting surface 66 is situated rearward of the engage portion 45 in the insertion direction 56 and away from the engage portion 45 in the insertion and removal direction 50. In other words, the abutment 65 may be arranged such that the abutting surface 66 is situated away from the engage portion 45 toward the removal direction 55. The abutting surface 66 of the abutment 65 may be configured to be able to receive a biasing force from the front to the rear. With compression of the coil spring 64 in the rear direction caused by the biasing force, the abutment 65 can also be moved in the rear direction. When the biasing force is released, the compressed coil spring may be moved so as to return. With this returning movement, the abutment 65 may be also moved to its original position.

The abutting surface 66 of the abutment 65 may come into contact with the engage member 145 above an axis 83 of the engage member 145 described below (see FIG. 5B). In other words, the abutting surface 66 may come into contact with the engage member 145 outside the main body 31 with respect to the axis 83 of the engage member 145. In the present embodiment, the abutment 65 may be a substantially rectangular parallelepiped member. The abutment 65 is not limited to the rectangular parallelepiped shape and may be any shape at which it can come into contact with the engage member 145.

Figure 5A:
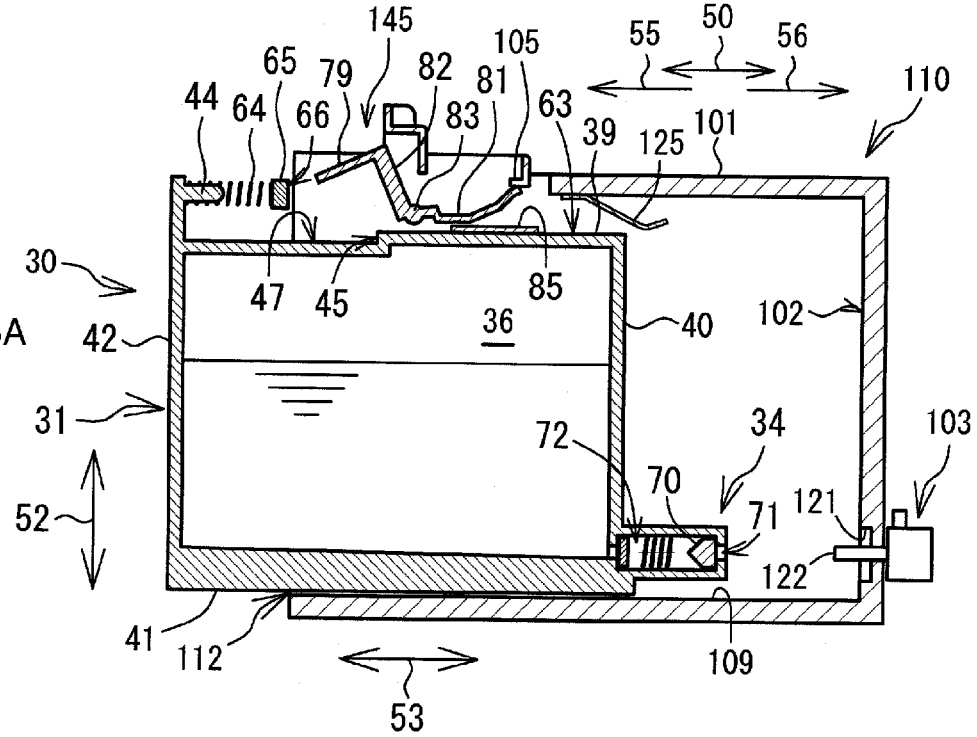
FIGS. 5A and 5B are cross-sectional views that illustrate a process of inserting the ink cartridge into the cartridge attaching unit.
Figure 5B:
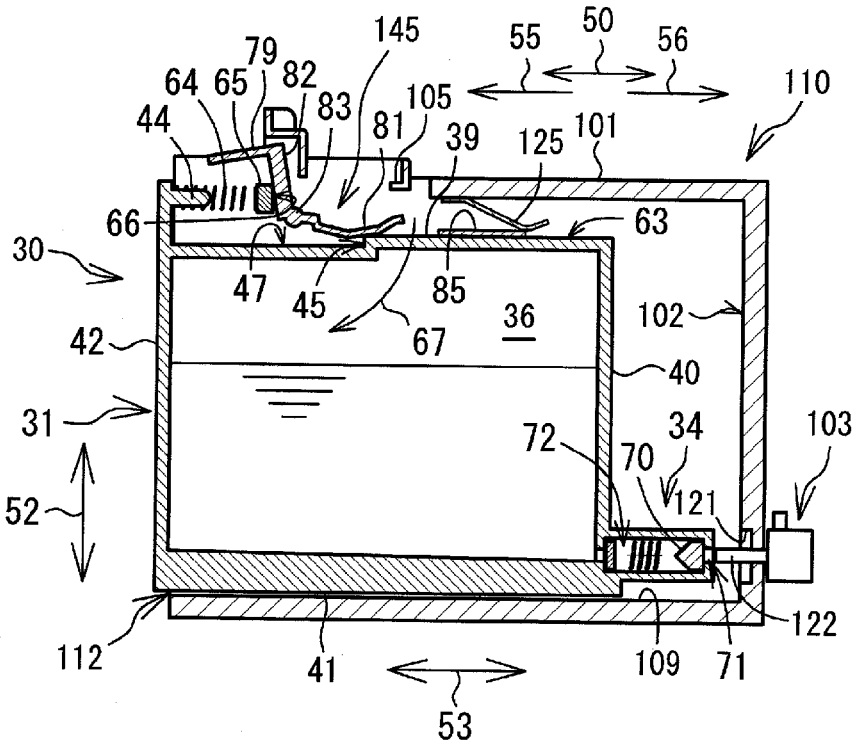

The abutting surface 66 may come into contact with the engage member 145 in the course of movement of the ink cartridge 30 in the insertion direction 56 to attach the ink cartridge 30 into the cartridge attaching unit 110 (see FIG. 5B). When the ink cartridge 30 is further moved in the insertion direction 56 in a state where the abutting surface 66 and the engage member 145 are in contact with each other, the coil spring 64 may be compressed (see FIG. 6A). This causes the coil spring 64 to provide the abutment 65 with a biasing force in the insertion direction 56. Even when the ink cartridge 30 is attached to the cartridge attaching unit 110, the state where the abutting surface 66 and the engage member 145 are in contact with each other may be maintained (see FIG. 6B). The details of how the ink cartridge 30 may be attached to the cartridge attaching unit 110 are described below.

IC Board 85

As illustrated in FIGS. 2 and 3, an IC board 85 may be disposed on the upper wall 39 of the main body 31, that is, on the outer surface of the main body 31 and on the same side as that where the engage portion 45 is disposed. The IC board 85 may be nearer the front wall 40 than the engage portion 45 in the upper wall 39 and be arranged below the abutment 65. Any method may be used in mounting the IC board 85 on the upper wall 39. For example, the IC board 85 may be fastened to the upper wall 39 of the main body 31 with screws or may be fixed to the upper wall 39 of the main body 31 by being fit in a groove previously formed in the upper wall 39.

Electrodes 86, 87, and 88 may be disposed on the upper surface of the IC board 85. The electrodes 86, 87, and 88 may extend in the longitudinal direction 53 on the upper surface of the IC board 85 and be spaced away from one another in the lateral direction 51. The electrodes 86, 87, and 88 may be exposed upward such that they can be accessed from the above. The electrodes 86, 87, and 88 may serve as an electrical interface. Examples of the electrodes 86, 87, and 88 can include a HOT electrode, a GND electrode, and a signal electrode. The IC board 85 may be provided with an IC (not illustrated) electrically connected to each of the electrodes 86, 87, and 88. The IC may be a semiconductor integrated circuit and store data indicating information about the ink cartridge 30, for example, a lot number, the date of manufacture, and an ink color, such that the data can be read out.

Ink Supply Apparatus 100

As illustrated in FIG. 1, the ink supply apparatus 100 may be included in the printer 10. The ink supply apparatus 100 may be configured to supply ink to the recording head 21 included in the printer 10. The ink supply apparatus 100 may include the cartridge attaching unit 110 to which the ink cartridge 30 can be attached. FIG. 1 illustrates the state where the ink cartridge 30 is attached to the cartridge attaching unit 110.

Cartridge Attaching Unit 110

Figure 4B:
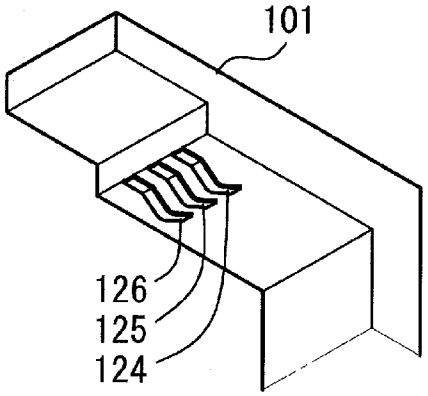
FIG. 4B is a perspective view that illustrates contacts and their surroundings in the cartridge attaching unit.
Figure 4A:
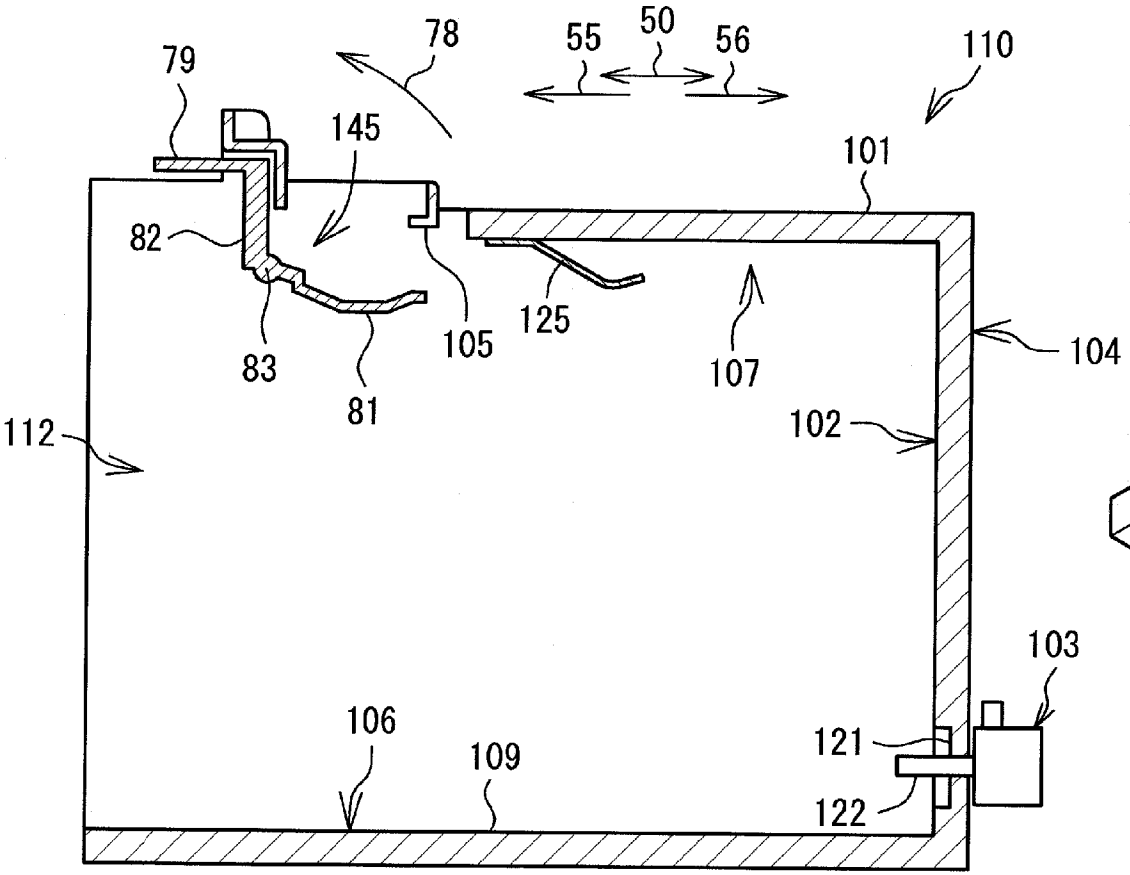
FIG. 4A is a cross-sectional view that illustrates an internal configuration of a cartridge attaching unit.

As illustrated in FIG. 4A, a case 101 forming the housing of the cartridge attaching unit 110 may have an opening 112 on the rear side of the printer 10. The ink cartridge 30 may be insertable into and removable from the case 101 through the opening 112. The lower wall 41 of the ink cartridge 30 may be inserted into a guide groove 109 in a bottom surface 106 defining the bottom portion of the inner space of the case 101, and thus the ink cartridge 30 may be guided along the insertion and removal direction 50. The guide groove 109 may be recessed downward from the bottom surface 106 and may extend linearly along the insertion and removal direction 50. The width of the guide groove 109 (outer dimension in the lateral direction 51) may be slightly larger than the width of the main body 31 of the ink cartridge 30 (outer dimension in the lateral direction 51) and be substantially constant over the insertion and removal direction 50.

Connecting Unit 103

As illustrated in FIGS. 1 and 4A, a connecting unit 103 may be disposed on the lower portion of an end surface 102 of the case 101. The connecting unit 103 may be arranged in a position corresponding to the ink outlet portion 34 of each of the ink cartridges 30 attached to the case 101.

The connecting unit 103 may include the ink needle 122 and a holding unit 121. The ink needle 122 may be made of a tube-shaped resin needle. The ink needle 122 may be connected to the ink tube 20 on the side corresponding to an outer surface 104 of the case 101. The end surface 102 and the outer surface 104 may be the inside and outside surfaces of the case 101, respectively. The ink tube 20 drawn from the ink needle 122 toward the outer surface 104 of the case 101 may extend so as to be able to supply ink to the recording head 21 in the printer 10. In FIG. 4A, the ink tube 20 is omitted.

The holding unit 121 may have a substantially cylindrical shape. The ink needle 122 may be arranged in a central portion of the holding unit 121. As illustrated in FIG. 6B, when the ink cartridge 30 is attached to the cartridge attaching unit 110, the ink outlet portion 34 may be inserted into the cylinder of the holding unit 121. At this time, the outer circumferential surface of the ink outlet portion 34 may come into contact with the inner circumferential surface of the cylinder of the holding unit 121, and thus the ink outlet portion 34 may be inserted into the holding unit 121 while being positioned thereto. When the ink outlet portion 34 may be inserted into the holding unit 121, the ink needle 122 may be inserted into the ink supply port 71 in the ink outlet portion 34. In this way, the ink stored in the ink chamber 36 may be made to be able to flow to the outside. The ink having flowed out of the ink chamber 36 may flow in the ink needle 122 and pass through the ink needle 122. The ink having passed through the ink needle 122 may flow in the ink tube 20 and may be supplied to the recording head 21.

Engage Member 145

As illustrated in FIG. 4A, the engage member 145 may be disposed rearward of a top surface 107 defining the top portion of the inner space of the case 101 in the insertion direction 56 and in the upper portion of the opening 112 of the case 101. The engage member 145 may be used for holding the ink cartridge 30 attached to the cartridge attaching unit 110 at the attached state. The engage member 145 may be a bent flat shape. The engage member 145 may include the axis 83 extending along the lateral direction 51 at a bend. The axis 83 may serve as a rotating shaft. The axis 83 may be rotatably mounted on the case 101. The engage member 145 can rotate about the axis 83.

The engage member 145 may include a front side portion 81 forward of the axis 83 in the insertion direction 56. The front side portion 81 may extend from the axis 83 substantially in the insertion direction 56. The front side portion 81 may be curved such that its lower portion is the outer portion of the curve. Thus the front side portion 81 may be curved upward in the vicinity of its leading end. The position of the leading end of the front side portion 81 in the insertion and removal direction 50 may be substantially the same as the position of the engage portion 45 in the state where the ink cartridge 30 may be attached to the cartridge attaching unit 110.

The engage member 145 may include a rear side portion 82 rearward of the axis 83 in the insertion direction 56. The rear side portion 82 may extend from the axis 83 substantially upward. The engage member 145 may include a projecting portion 79 projecting substantially in the removal direction 55 at the extending end of the rear side portion 82.

The rear side portion 82 may be heavier than the front side portion 81. Thus in a state where no external force is exerted on the engage member 145, the engage member 145 rotates in a direction in which the front side portion 81 moves upward and the rear side portion 82 moves downward, that is, in a direction indicated by an arrow 78. An abutment wall 105 capable of coming into contact with the front side portion 81 having rotated in the direction of the arrow 78 may be disposed on the upper portion of the case 101. The position of the engage member 145 in a state where the front side portion 81 is in contact with the abutment wall 105 may serve as a second position. As described below, the front side portion 81 of the engage member 145 in the second position does not engage with the ink cartridge 30 lying in the attached position.

When the engage member 145 may be in the second position, the ink cartridge 30 may be rotated in a direction opposite the direction of the arrow 78 by a user of the ink supply apparatus 100 pressing the projecting portion 79 forward. Thus the front side portion 81 may move downward from the second position. The position of the engage member 145 in a state where the front side portion 81 may be situated below that in the second position may serve as a first position. As described below, the engage member 145 in the first position may engage with the ink cartridge 30 in the attached position. In the above-described manner, the engage member 145 may be disposed on the case 101 so as to be able to rotate to the first position and the second position. FIG. 4B illustrates a state where the engage member 145 is in the first position.

Contacts 124, 125, 126

As illustrated in FIG. 4B, contacts 124, 125, and 126 may be disposed forward of the engage member 145 in the insertion direction 56 on the top surface 107 of the case 101. The contacts 124, 125, and 126 may be disposed in positions opposing the electrodes 86, 87, and 88 on the upper surface of the IC board 85 in the state where the ink cartridge 30 is attached to the cartridge attaching unit 110, that is, in the state where the ink cartridge 30 is in the attached position. The contacts 124, 125, and 126 may be configured to be able to be elastically deformed in the vertical direction 52 by being pressed in contact with the electrodes 86, 87, and 88 on the upper surface of the IC board 85 in the state where the ink cartridge 30 is in the attached position. With this movement, the electrodes 86, 87, and 88 may be brought into electrical conduction with the contacts 124, 125, and 126.

Each of the contacts 124, 125, and 126 may be electrically connected to an arithmetic device through an electrical circuit. The arithmetic device may include a central processing unit (CPU), a read-only memory (ROM), a random-access memory (RAM), or other unit, for example, and may be configured as a controller for the printer 10. When the contact 124 and the electrode 86 (HOT electrode) may be brought into electrical conduction, a predetermined voltage Vc may be applied to the HOT electrode. When the contact 125 and the electrode 87 (GND electrode) are brought into electrical conduction, the GND electrode may be earthed. When the contacts 124 and 125 are brought into electrical conduction with the HOT electrode and the GND electrode, respectively, power may be applied to the IC on the IC board 85. When the contact 126 and the electrode 87 (signal electrode) may be brought into electrical conduction, the data stored in the IC may become accessible. An output from the electrical circuit may be input into the arithmetic device. The number of the contacts and the number of the electrodes are not limited to three. They may be less than three or more than three.

Operations of Attaching and Removing Ink Cartridge 30

An operation of attaching the ink cartridge 30 to the cartridge attaching unit 110 and an operation of removing the ink cartridge 30 from the cartridge attaching unit 110 may be described below with reference to FIGS. 5A to 7C.

First, as previously described, the engage member 145 may be configured that the rear side portion 82 is heavier than the front side portion 81. In a state where the ink cartridge 30 is not inserted into the cartridge attaching unit 110, as illustrated in FIG. 5A, the front side portion 81 in the engage member 145 in the cartridge attaching unit 110 may be situated upward. The upper surface of the front side portion 81 situated upward may be in contact with the abutment wall 105. That is, the engage member 145 is in the second position. As described above, in the state where the ink cartridge 30 is not inserted into the case 101 of the cartridge attaching unit 110, the engage member 145 may be held in the second position.

In the above-described state, the ink cartridge 30 in the standing position (see FIGS. 2 and 3) may be inserted into the case 101. At the time of the insertion, the foremost projecting end of the ink outlet portion 34 in the ink cartridge 30 may be inserted into the opening 112. Then, as illustrated in FIG. 5A, the lower wall 41 and the upper wall 39 of the main body 31 rearward of the ink outlet portion 34 in the insertion direction 56 in the ink cartridge 30 may be inserted into the opening 112.

When the lower wall 41 is inserted into the opening 112, it may be inserted into the guide groove 109. Thus the lower wall 41 may be fit into the guide groove 109, and the ink cartridge 30 may be positioned in the lateral direction 51 (direction orthogonal to FIGS. 5A to 6B) inside the case 101. The lower wall 41 may be supported by the bottom surface of the guide groove 109, and thus the ink cartridge 30 may be positioned with respect to the downward direction inside the case 101.

When the upper wall 39 is inserted into the opening 112, the front side portion 81 in the engage member 145 may face the upper wall 39 and the IC board 85.

When the ink cartridge 30 is further inserted toward the end surface 102 of the case 101 in the insertion direction 56 from the state illustrated in FIG. 5A, the abutting surface 66 of the abutment 65 may come into contact with the rear side portion 82 in the engage member 145, as illustrated in FIG. 5B. In this state, when the ink cartridge 30 is inserted toward the end surface 102 of the case 101, the coil spring 64 may be contracted by receiving a reaction force from the rear side portion 82 in the engage member 145 (see FIG. 6A). That is, in the course of insertion of the ink cartridge 30 into the cartridge attaching unit 110, the abutment 65 comes into contact with the engage member 145, and this causes the coil spring 64 to be elastically deformed toward the rear wall 42.

In the state where the coil spring 64 is contracted, when the ink cartridge 30 is inserted toward the end surface 102 of the case 101, as illustrated in FIG. 5B, the rear side portion 82 in the engage member 145 may be pressed by the abutment 65 in the insertion direction 56, and thus the engage member 145 may be rotated in a direction indicated by an arrow 67. Thus the front side portion 81 in the engage member 145 may come into contact with an upper surface 63 of the upper wall 39.

In the state illustrated in FIG. 5B, when the ink cartridge 30 is further inserted toward the end surface 102 of the case 101 in the insertion direction 56, the engage member 145 may be further rotated in the direction of the arrow 67. Thus, as illustrated in FIG. 6A, the leading end of the front side portion 81 in the engage member 145 may come into contact with the upper surface 63 of the upper wall 39 and be brought into a state where it is supported by the upper surface 63 of the upper wall 39.

Figure 6A:
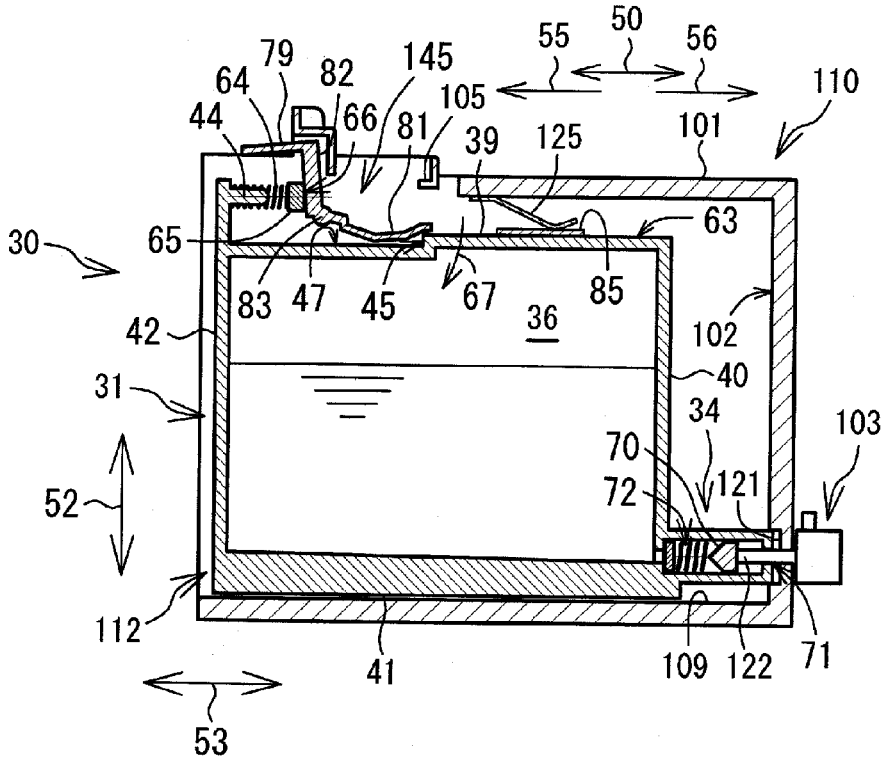
FIG. 6A is a cross-sectional view that illustrates a process of inserting the ink cartridge into the cartridge attaching unit.
Figure 6B:
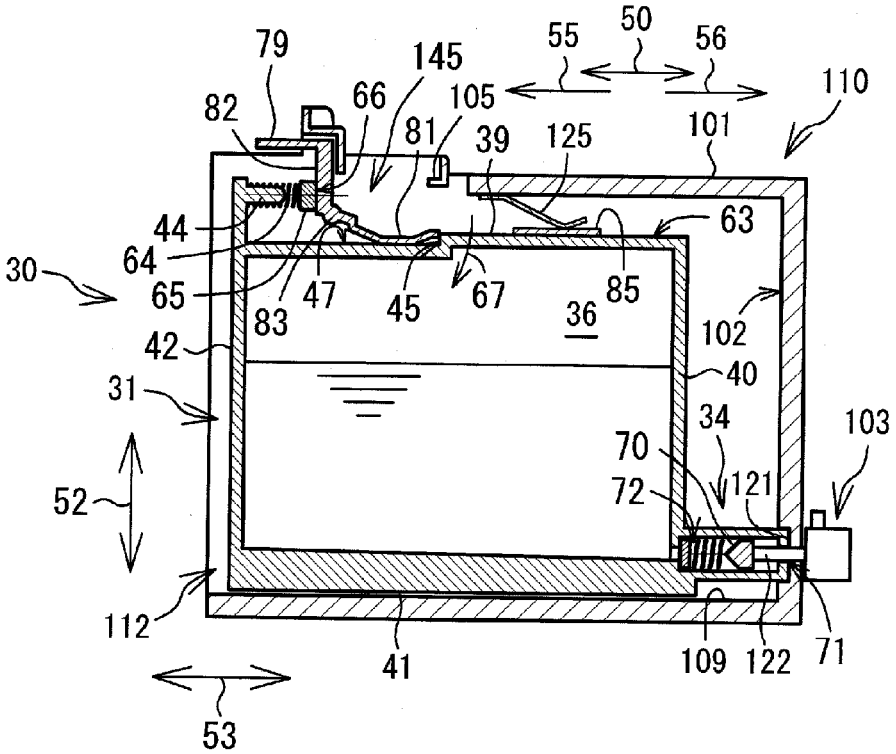
FIG. 6B is a cross-sectional view that illustrates a state where the ink cartridge is attached to the cartridge attaching unit.

In the state illustrated in FIG. 6A, when the ink cartridge 30 is further inserted toward the end surface 102 of the case 101 in the insertion direction 56, the ink cartridge 30 may reach the attached position, as illustrated in FIG. 6B. At this time, the leading end of the front side portion 81 in the engage member 145 may be situated rearward of the upper wall 39 in the insertion direction 56. Because this may bring the leading end of the front side portion 81 in the engage member 145 into the state where it is not supported by the upper wall 39, the rear side portion 82 is pressed by a reaction force of the coil spring 64 in the insertion direction 56, and thus the engage member 145 may be rotated in the direction of the arrow 67. As a result, the leading end of the front side portion 81 in the engage member 145 may be in the state illustrated in FIG. 6B. The position of the engage member 145 at this time may be the first position. In the above-described manner, in the course of insertion of the ink cartridge 30 into the cartridge attaching unit 110, the abutment 65 may come into contact with the engage member 145 and rotate the engage member 145 to the first position. In movement of the front side portion 81 in the engage member 145 from the second position to the first position, the contacts 124, 125, and 126 may come into contact with the electrodes 86, 87, and 88 and slide thereon. In movement of the ink cartridge 30 in the removal direction 55, the ink cartridge 30 may receive a reaction force occurring when the ink supply valve 70 in the ink outlet portion 34 presses the ink needle 122 while returning to a closed position, in addition to the force from the coil spring 64.

In a state where the engage member 145 is situated in the first position, the leading end of the front side portion 81 in the engage member 145 may be in contact with the engage portion 45 in the ink cartridge 30. Thus the engage member 145 may engage with the engage portion 45. As a result, the leading end of the front side portion 81 in the engage member 145 may prevent the ink cartridge 30 from being drawn from the attached position by the coil spring 64 receiving a biasing force that moves the ink cartridge 30 in the removal direction 55. That is, when the ink cartridge 30 reaches the attached position in the cartridge attaching unit 110, the engage member 145 in the first position may engage with the engage portion 45, and the ink cartridge 30 may be held in the attached position against the biasing force of the coil spring 64. In this way, the attachment of the ink cartridge 30 to the cartridge attaching unit 110 may be completed. In this attachment completed state, the electrodes 86, 87, and 88 of the IC board may be in a state where they are accessed from the above through the contacts 124, 125, and 126 of the cartridge attaching unit 110 and may be in electrical contact with each other.

When the ink cartridge 30 in the state illustrated in FIG. 5A is further inserted toward the end surface 102 of the case 101 in the insertion direction 56, the ink needle 122 may be inserted into the ink supply port 71 of the ink outlet portion 34, as illustrated in FIG. 5B. When the ink needle 122 is inserted into the ink supply port 71 and comes into contact with the ink supply valve 70 and the ink cartridge 30 is further moved in the insertion direction 56, the ink supply valve 70 may be pressed by the ink needle 122 and separated from the ink supply port 71, as illustrated in FIG. 6A. Then, the ink needle 122 is further inserted into the ink supply port 71, and thus the main body 31 in the ink cartridge 30 may be attached in a predetermined position in the case 101, as illustrated in FIG. 6B. Although not illustrated in the drawings, the ink needle 122 may include an ink introducing port in its leading end, and the ink may flow from the ink chamber 36 into the ink needle 122 through the ink introducing port.

When the ink in the ink chamber 36 in the ink cartridge 30 is consumed, the expended ink cartridge 30 may be detached from the cartridge attaching unit 110, and a new ink cartridge 30 may be attached.

Figure 7A:
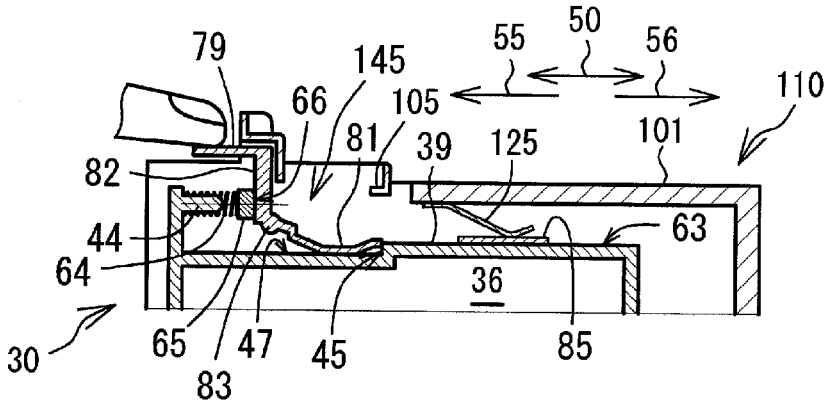
FIGS. 7A, 7B, and 7C are cross-sectional views that depict a process of removing the ink cartridge from the cartridge attaching unit and illustrate an upper portion of the ink cartridge and the cartridge attaching unit.
Figure 7B:
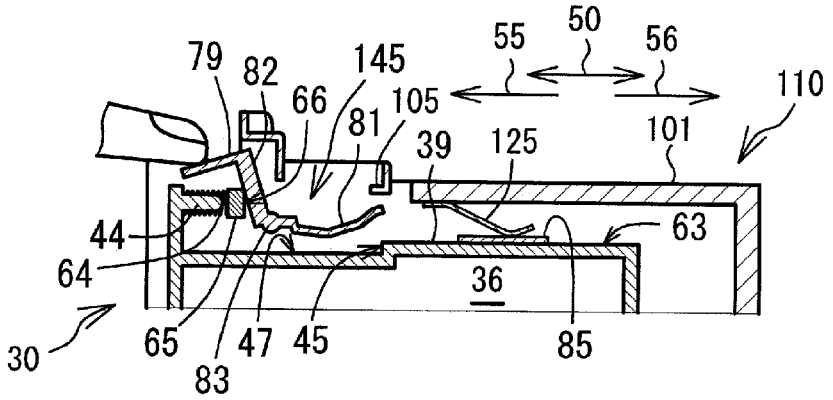
Figure 7C:
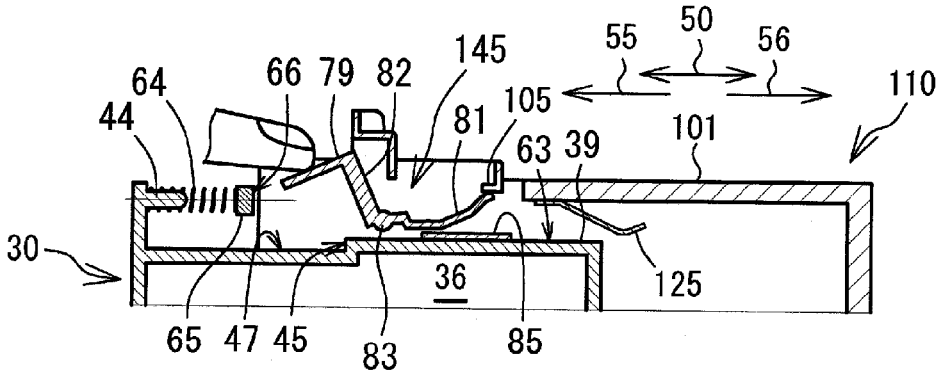

At the time of detaching the ink cartridge 30 from the cartridge attaching unit 110, the projecting portion 79, which projects from the rear side portion 82 in the engage member 145, may be pressed downward by a user, as illustrated in FIG. 7A. Thus the front side portion 81 in the engage member 145 may be rotated from the first position illustrated in FIG. 7A to the second position illustrated in FIG. 7B. With this rotation of the front side portion 81, the engage member 145 may be brought into a state where the leading end of the front side portion 81 and the engage portion 45 are not in contact with each other. That is, the rotation of the engage member 145 to the second position may disengage the engage member 145 from the engage portion 45. Thus the leading end of the front side portion 81 in the engage member 145 may not receive a biasing force in which the coil spring 64 moves the ink cartridge 30 in the removal direction 55. The coil spring 64 may transfer a force that returns its contracted state to its original state, to the abutment 65 being in contact with the rear side portion 82 in the engage member 145, and its reaction force may move the ink cartridge 30 in the removal direction 55. As a result, the holding of the ink cartridge 30 by the engage member 145 may be released, and the ink cartridge 30 may be moved in the removal direction 55 by the biasing force of the coil spring 64, as illustrated in FIG. 7C.

As described above, when the engage member 145 in the state where the ink cartridge 30 is held in the attached position is rotated from the first position to the second position, the biasing force of the coil spring 64 may move the ink cartridge 30 in a direction opposite the insertion direction 56. In such a way, the ink cartridge 30 may be detached from the cartridge attaching unit 110.

ADVANTAGEOUS EFFECTS IN PRESENT EMBODIMENT

According to the present embodiment, because the biasing member for biasing the ink cartridge 30 in the removal direction 55 and the biasing member for biasing the engage member 145 for holding the ink cartridge 30 in the attached position may be the same, the ink supply apparatus 100 can have a reduced number of parts.

According to the present embodiment, because the abutment 65 may work with elastic deformation of the coil spring 64 and move in the direction extending along the insertion direction 56, the time lag between elastic deformation of the coil spring 64 and contact between the abutment 65 and the engage member 145 can be reduced.

According to the present embodiment, because the compressible coil spring 64 is used, the function of holding the ink cartridge 30 described above can be implemented with a simple structure.

According to the present embodiment, because the engage portion 45 is a rise, the shape of the ink cartridge 30 can be uncomplicated.

According to the present embodiment, because the coil spring 64 is arranged above the ink outlet portion 34 in an attached state, there is a reduced possibility that ink flowing out of the ink outlet portion 34 adheres to the coil spring 64.

According to the present embodiment, because the abutment 65 comes into contact with the engage member 145 outside the main body 31 with respect to the axis 83 of the engage member 145, that is, above the axis 83. Thus the abutment 65 can reliably rotate the engage member 145 in the direction of the arrow 67.

According to the present embodiment, the engage member 145 is held in the second position in the state where the ink cartridge 30 is not inserted into the cartridge attaching unit 110. When the engage member 145 is in the second position, the front side portion 81 in the engage member 145 is rotated upward. Thus the front side portion 81 in the engage member 145 can be prevented from interfering with the insertion of the ink cartridge 30 into the case 101.

According to the present embodiment, because the engage member 145 is held in the second position in the state where the ink cartridge 30 is not inserted into the case 101, there is a reduced possibility that in the course of insertion of the ink cartridge 30 into the case 101, the front side portion 81 in the engage member 145 comes into contact with the IC board 85.

VARIATIONS

In the above-described embodiment, the abutment 65 is mounted on the coil spring 64, and the abutment 65 may come into contact with the engage member 145. However, the abutment 65 may not be mounted on the coil spring 64. In this case, the end of the coil spring 64 may come into contact with the engage member 145. That is, the coil spring 64 may serve as both the biasing member and the abutting unit. That is, the abutting unit may be a portion of the biasing member. When the abutting unit is a portion of the biasing member, the ink supply apparatus 100 can have a reduced number of parts.

Figure 8A:
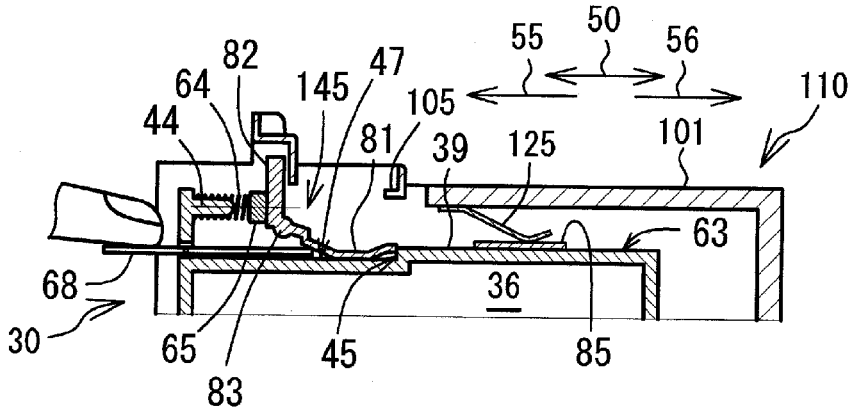
FIGS. 8A, 8B, and 8C are cross-sectional views that depict a process of removing the ink cartridge from the cartridge attaching unit according to a variation and illustrate the upper portion of the ink cartridge and the cartridge attaching unit.
Figure 8B:
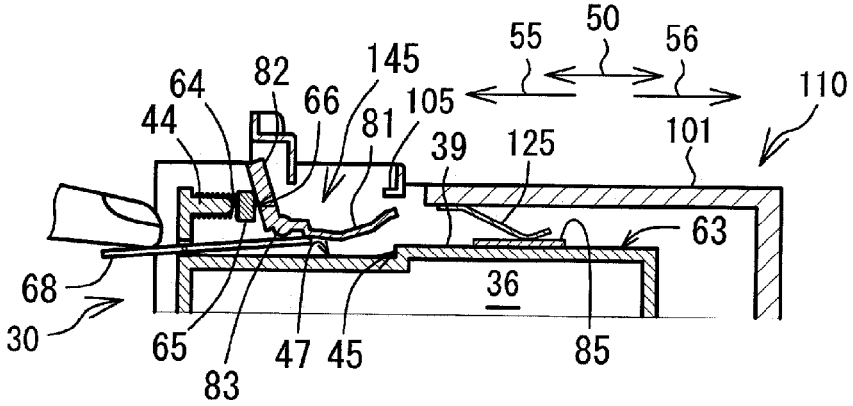
Figure 8C:
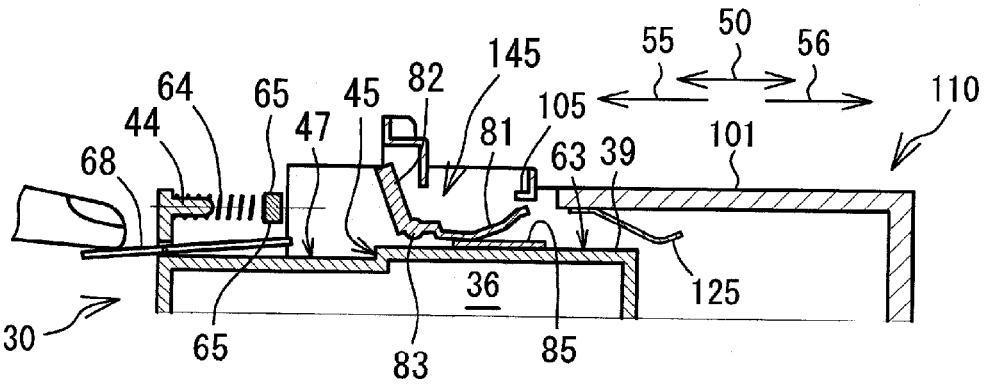

In the above-described embodiment, the engage member 145 may be configured such that it is rotated by an operation performed by a user. The engage member 145 is not limited to the configuration in the above-described embodiment, in which it is operated by a user, as long as the engage member 145 in the first position engage with the engage portion 45. For example, as illustrated in FIG. 8A, the ink cartridge 30 may include an operation lever 68 configured to be rotated by an operation performed by a user. As illustrated in FIG. 8B, the engage member 145, which is disposed on the case 101 in the cartridge attaching unit 110, may be rotated by being pressed in contact with the rotating operation lever 68 and may be rotated from the first position to the second position. When the engage member 145 is moved from the first position to the second position, the ink cartridge 30 is moved in the removal direction 55 by the biasing force of the coil spring 64 (see FIG. 8C), as in the case of the above-described embodiment.

In the above-described embodiment, the coil spring 64 is arranged so as to expand and contract in the longitudinal direction 53. However, the coil spring 64 may be arranged so as to expand and contract in the vertical direction 52. That is, a biasing force provided to the abutment 65 by the engage member 145 may be converted into a force in the vertical direction 52 by a link mechanism or other mechanism, the force may be transferred to the coil spring 64, and this may cause the coil spring 64 to expand and contract. In this manner, a force in which the coil spring 64 returns occurring when the engaged state by the engage member 145 is released can be transferred to the abutment 65, and the ink cartridge 30 can be moved in the removal direction 55.

In the above-described embodiment, the coil spring 64 is described as an example of the biasing member. The biasing member may be other elements, including a resin rubber element. The support wall 43 may have a leaf spring shape deformable in the longitudinal direction 53 and configured to be able to urge the abutment 65 against the engage member 145.

What is claimed is:

1. A printing apparatus, comprising:

a casing configured to accept a cartridge;

an engage member configured to rotate between a first position and a second position; and a biasing member attached to the cartridge, and configured to provide a biasing force against the engage member, wherein when the engage member is in the first position, the biasing force locks the cartridge in the casing in a first direction, and wherein when the engage member is in the second position, the biasing force urges the engage member in the first direction and the cartridge in a second direction, opposite the first direction, to eject the cartridge from the casing.

2. The apparatus of claim 1, wherein the engage member includes an axis of rotation, and wherein the biasing member abuts the engage member at a first location on the engage member, and wherein a smallest distance between the axis of rotation and a support surface of the cartridge is smaller than a smallest distance between the first location and the support surface of the cartridge.

3. The apparatus of claim 1, wherein the biasing member includes a contact portion that abuts the engage member at a first location on the engage member.

4. The apparatus of claim 1, wherein the biasing member is a spring.

5. The apparatus of claim 1, wherein the engage member has a first end, and is configured such that the first end abuts an engage portion of the cartridge when the engage member is in the first position.

6. The apparatus of claim 5, wherein the engage portion is a vertical step from an upper surface of the cartridge.

7. The apparatus of claim 1, further comprising the casing including the engage member;

wherein the cartridge comprises a main body configured to be inserted into the casing in the first direction and a protrusion extending in the first direction; and wherein the biasing member is coupled to the protrusion.

8. A cartridge, comprising:

a main body configured to be inserted into a device in a first direction;

a biasing portion configured to provide a biasing force in the first direction; and an engage portion, wherein the cartridge is configured to accept an engage member of the device between the biasing portion and the engage portion, and to convey the biasing force to the engage portion via the engage member, and wherein the biasing portion includes a contact portion configured to abut the engage member at a first location on the engage member.

9. The cartridge of claim 8, wherein the biasing portion is located above a support surface of the cartridge, wherein the biasing portion is configured to abut the engage member at a first location on the engage member, and wherein a smallest distance between an axis of rotation and the support surface of the cartridge is smaller than a smallest distance between the first location and the support surface of the cartridge.

10. The cartridge of claim 8, wherein the biasing portion is coupled to a protrusion extending frontwards from a rear of the main body.

11. The cartridge of claim 8, wherein the biasing portion is a spring.

12. The cartridge of claim 8, wherein the biasing portion is configured such that the biasing force locks the cartridge into the device in a first direction when the engage member is in a first position, and urges the cartridge in a second direction, opposite the first direction, to eject the cartridge from the device when the engage member is in a second position.

13. A cartridge, comprising:

a main body having a front and a rear;

a biasing portion located above an upper surface of the main body and coupled to a support extending above the upper surface of the main body, configured to provide a biasing force towards the front of the main body; and an engage portion on the upper surface of the main body, wherein the engage portion is a rise facing the rear of the main body, and wherein the biasing portion is located rearward of the engage portion.

14. The cartridge of claim 13, wherein the upper surface is a top surface having a flat support surface and a flat upper wall, and wherein the engage portion is a vertical step from the support surface to the upper wall.

15. The cartridge of claim 13, wherein the biasing portion is coupled to a protrusion extending frontwards from the support.

16. The cartridge of claim 13, wherein the cartridge is configured to accept an engage member of a device between the biasing portion and the engage portion, and to convey the biasing force to the engage portion via the engage member.

17. The cartridge of claim 13, wherein the biasing portion includes a contact portion.

18. The cartridge of claim 13, wherein the biasing portion is a spring.

19. The cartridge of claim 13, wherein the biasing portion is configured such that the biasing force locks the cartridge into a device in a first direction when an engage member of the device is in a first position, and urges the cartridge in a second direction, opposite the first direction, to eject the cartridge from the device when the engage member is in a second position.

* * * * *